US009114640B2

(12) United States Patent
Takatsu et al.

(10) Patent No.: US 9,114,640 B2
(45) Date of Patent: Aug. 25, 2015

(54) PRINTING METHOD

(71) Applicant: MIMAKI ENGINEERING CO., LTD., Nagano (JP)

(72) Inventors: Akira Takatsu, Nagano (JP); Tomotaka Furuhata, Nagano (JP); Akira Takeuchi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/389,380

(22) PCT Filed: Apr. 24, 2013

(86) PCT No.: PCT/JP2013/061992
§ 371 (c)(1),
(2) Date: Sep. 30, 2014

(87) PCT Pub. No.: WO2013/161847
PCT Pub. Date: Oct. 31, 2013

(65) Prior Publication Data

US 2015/0062270 A1 Mar. 5, 2015

(30) Foreign Application Priority Data

Apr. 27, 2012 (JP) ..... 2012-104171

(51) Int. Cl.
*B41J 2/01* (2006.01)
*B41J 11/00* (2006.01)
(Continued)

(52) U.S. Cl.
CPC ..... *B41J 11/002* (2013.01); *B41M 5/0023* (2013.01); *B41M 7/0081* (2013.01)

(58) Field of Classification Search
USPC ..... 347/16, 100, 102
See application file for complete search history.

(56) References Cited

U.S. PATENT DOCUMENTS 4,233,195 A * 11/1980 Mills ..... 524/441
7,244,021 B2 * 7/2007 Arai ..... 347/102
7,399,688 B2 * 7/2008 Iwata ..... 438/500
(Continued)

FOREIGN PATENT DOCUMENTS

JP 09-279078 10/1997
JP 2004-042548 2/2004
(Continued)

OTHER PUBLICATIONS

"International Search Report (Form PCT/ISA/210)", mailed on Jul. 23, 2013, pp. 1-4.

*Primary Examiner* — Anh T. N. Vo
(74) *Attorney, Agent, or Firm* — Jianq Chyun IP Office

(57) ABSTRACT

The problem addressed by the present invention lies in obtaining printed material having higher brightness using an ultraviolet-curing metallic ink. In order to solve this problem, the printing method includes: an ink ejection process, in which an ultraviolet curing type metallic ink including metal particles is ejected on a recording medium, and the recording medium is swelled by the metallic ink, soaked with the metallic ink, or dissolved by the metallic ink; a leveling process, in which the metallic ink on the recording medium is leveled; a temporary curing process, in which ultraviolet rays are irradiated to the metallic ink on the recording medium to cure in such a degree that the metallic ink is not completely cured; and a main curing process, in which ultraviolet rays are irradiated to the metallic ink on the recording medium for curing after the temporary curing process.

10 Claims, 1 Drawing Sheet

(51) Int. Cl.
*B41M 5/00* (2006.01)
*B41M 7/00* (2006.01)

(56) References Cited

U.S. PATENT DOCUMENTS 8,262,209 B2 * 9/2012 Nitta et al. ..... 347/89
8,454,117 B2 * 6/2013 Shimizu et al. ..... 347/21
8,529,009 B2 * 9/2013 Onishi ..... 347//16
8,662,654 B2 * 3/2014 Onishi ..... 347/102

FOREIGN PATENT DOCUMENTS

JP 2005-002277 1/2005
JP 2008-105382 5/2008
JP 2008-221468 9/2008
JP 2012-017466 1/2012
JP 2012-045908 3/2012

* cited by examiner

PRINTING METHOD

CROSS-REFERENCE TO RELATED APPLICATION

This application is a 371 application of an international PCT application serial no. PCT/JP2013/061992, filed on Apr. 24, 2013, which claims the priority benefit of Japan application no. 2012-104171, filed on Apr. 27, 2012. The entirety of each of the above-mentioned patent applications is hereby incorporated by reference herein and made a part of this specification.

FIELD OF THE INVENTION

The present invention relates to a printing method of a metallic ink.

BACKGROUND ART

Printing ink for performing metallic tone pad printing has been described in Patent Literature 1.

CITATION LIST

Patent Literature

[Patent Literature 1] Japanese Patent Laid-Open No. Hei 9-279078 (published on Oct. 28, 1997)

SUMMARY OF INVENTION

Technical Problem

When a metallic ink is to be printed, there are some applications of an obtained printed matter in which high brightness is preferable. This is also similar to a case that an ultraviolet curing type metallic ink is used.

Therefore, the present inventors have executed earnest examination and consideration for further improving brightness of a printed matter with the use of an ultraviolet curing type metallic ink.

A metallic ink includes metal particles as a coloring agent, but the present inventors have found that, even when the content of metal particles is merely increased, the brightness is not sufficiently improved.

In view of the problem described above, an objective of the present invention is to provide a printing method for obtaining a printed matter having a higher brightness by using an ultraviolet curing type metallic ink.

Solution to Problem

A printing method in accordance with the present invention includes: an ink ejection process, in which an ultraviolet curing type metallic ink including metal particles is ejected on a recording medium, and the recording medium is swelled by the metallic ink, soaked with the metallic ink, or dissolved by the metallic ink; a leveling process, in which the metallic ink on the recording medium is leveled; a temporary curing process, in which ultraviolet rays are irradiated to the metallic ink on the recording medium to cure in such a degree that the metallic ink is not completely cured; and a main curing process, in which ultraviolet rays are irradiated to the metallic ink on the recording medium for curing after the temporary curing process.

A solvent of ink is penetrated into a recording medium, for example, by soaking and thereby the thickness of a formed ink layer can be made thin. When the ink layer is formed so that its thickness is thin, a moving range of metal particles is formed and thus the particles in a scale shape can be laid horizontally and aligned. In addition, since the thickness of the ink layer becomes thin, a difference of curing shrinkage between the surface and the inside (especially lower half side) due to shrinkage on curing can be reduced. If the curing shrinkage is large, even when the metal particles are aligned, their positions are displaced afterward and thus light reflects diffusely and desired brightness cannot be obtained. However, according to the present invention, curing shrinkage in the surface of the ink layer and its inside can be made small and thus the metal particles are further uniformly laid down horizontally to maintain the positions of the metal particles. Therefore, the brightness can be improved.

Further, excessive penetration of the metallic ink into the recording medium is suppressed by the temporary curing process, and thus the metallic ink is prevented from oozing from the inside of the recording medium to its surface to occur discoloration due to elapsing of time after the printing has been finished.

In the printing method in accordance with the present invention, the recording medium is provided with a receiving layer on a face where the metallic ink is landed, or the recording medium is paper or vinyl chloride.

In a case that the amount of a metallic ink to be ejected is large, an ink layer becomes thick and thus its surface side is cured and shrunk due to a difference of curability between the surface side of an ink droplet and its bottom side. When shrinkage on curing is occurred, orientation of the metal particles aligned so as to be parallel to a plane direction of a medium is disturbed and the brightness is lowered. In a case that a recording medium having a receiving layer is used or, in a case that paper, a fabric and the like are used as a recording medium, thickness of the ink layer can be made thinner by penetrating a metallic ink into the recording medium in such a degree that the metallic ink is not oozed so as to occur discoloration. As a result, a difference of curability between a surface side of an ink droplet and its bottom side can be made smaller and thus shrinkage on curing of the surface side can be suppressed. Therefore, disturbance of the orientation of metal particles can be suppressed and a high degree of brightness can be secured.

In the printing method in accordance with the present invention, it is preferable that a printing face of the recording medium which is provided with the receiving layer is performed with smoothing processing.

When an ink layer is thinly formed, movement of the metal particles is restricted to improve brightness but, on the other hand, when the ink layer is set to be thin, the ink layer is easily affected by a shape of the surface of a recording medium. For example, in a case that the surface smoothness is low, since metal particles are aligned along the surface, the metal particles cannot be sufficiently oriented in a direction parallel to the surface and thus the light may be diffusely reflected and the brightness is lowered. However, according to the above-mentioned structure, smoothness of a recording medium is improved in comparison with a case that the smoothing processing is not performed and thus, the metal particles are further aligned in order and the brightness is improved.

In the printing method in accordance with the present invention, it is preferable that, in the ink ejection process, the metallic ink is ejected by an inkjet printer so that landed ink droplets are flattened and unified with adjacent ink droplets before the main curing process is performed.

When adjacent ink droplets are unified with each other by leveling, the orientation where plane directions of the metal particles in a scale shape become parallel to a plane direction of a recording medium is further promoted. Therefore, the brightness is further improved.

In this case, it is further preferable that a recording medium is provided with a resin layer on a face where a metallic ink is landed, or the recording medium is paper or vinyl chloride. In order to eject a metallic ink so that adjacent ink droplets are unified with each other by leveling, it is required to increase an amount of the metallic ink to be ejected. However, even if a large amount of ink is ejected, the ink layer can be thinly formed when such a recording medium is used and thus a direction in which the metal particles are oriented can be restricted to improve the brightness.

In the printing method in accordance with the present invention, it is preferable that the leveling process is performed by heating the recording medium.

The leveling is further smoothly performed by heating. Further, even when a high viscous metallic ink is used, leveling can be performed smoothly.

In the printing method in accordance with the present invention, it is preferable that, in the leveling process, a surface of the recording medium is heated in a range of 40° C. or more and 70° C. or less and thereby the metallic ink is heated. The leveling can be performed further smoothly.

In the printing method in accordance with the present invention, it is preferable that the metal particle is a leafing type particle.

Since the metal particles are oriented on the surface of the ink layer so that plane directions of the metal particles in a scale shape are set to be parallel to a plane direction of a recording medium, the brightness is further improved.

Effects of the Invention

According to the present invention, a printed matter having a higher brightness can be obtained by using an ultraviolet curing type metallic ink.

DESCRIPTION OF EMBODIMENTS

Figure 1:
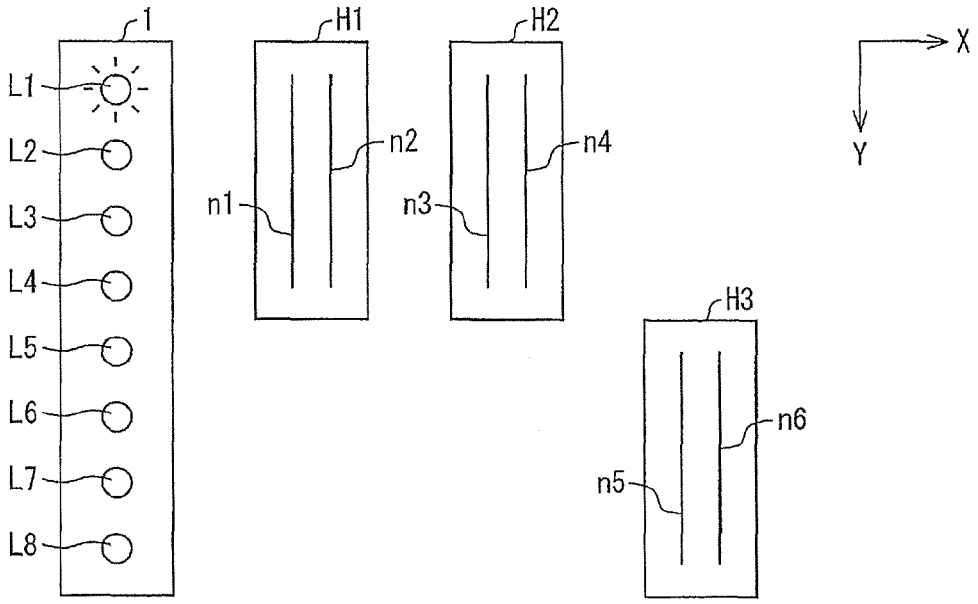
FIG. 1 is a view showing a structure of a head and an ultraviolet irradiation part of an inkjet printer for performing a printing method in accordance with the present invention.

A printing method in accordance with the present invention includes: an ink ejection process in which an ultraviolet curing type metallic ink including metal particles is ejected on a recording medium which is swelled by the metallic ink, soaked with the metallic ink, or dissolved by the metallic ink; a leveling process in which the metallic ink on the recording medium is leveled; a temporary curing process in which ultraviolet rays are irradiated to the metallic ink on the recording medium to cure in such a degree that the ink is not completely cured; and a main curing process in which ultraviolet rays are irradiated to the metallic ink on the recording medium for curing after the temporary curing process.

The landed metallic ink is leveled by the leveling process. In addition, a temporary curing process is performed in such a degree that the ink is not completely cured and thus excessive oozing of the metallic ink to the recording medium is suppressed and leveling can be performed further flatly. Further, a printed matter with a high brightness can be obtained by fully being cured after leveling has been performed sufficiently. Therefore, a printed matter with a further higher brightness can be obtained. In other words, although one of conditions for determining a posture of a metal particle is a surface shape of the ink layer, when the surface is set to be further close to a flat shape by leveling, metal particles can be aligned in a further well-ordered manner in a plane direction parallel to the surface of a recording medium in a state that the metal particles are interposed between the recording medium and the surface of the ink layer. Therefore, the brightness is improved.

Further, the present inventors have considered that, when ultraviolet rays are irradiated to an ultraviolet curing type metallic ink immediately after the ink has been landed on a recording medium, the ink is cured in a state that the metal particles are not sufficiently oriented and, as a result, sufficient brightness is not obtained due to diffused reflection. In other words, the present inventors have considered that metal particles of many metallic inks are formed in a scale shape and, when these plane directions are oriented so as to be parallel to a plane direction of a recording medium, the brightness is improved.

Therefore, a surface of a recording medium is heated beforehand and, after that, printing is performed and the surface of landed metallic ink is further flattened (leveled) by improving wettability of the metallic ink. And, when ultraviolet rays are irradiated to the metallic ink for curing, a printed matter with a high brightness is obtained.

Further, the present inventors have found that, in a case that a recording medium is provided with a receiving layer of resin or, in a case that the medium is paper or a fabric, as the time passes after printing has been performed by using a metallic ink, an ultraviolet curing resin component of the metallic ink is oozed out and the medium is changed in color to yellow or the like.

The present invention solves also such a problem. In other words, even in a case of a recording medium in which a metallic ink is easily oozed, excessive oozing of the metallic ink is suppressed and a printed matter with a higher brightness can be obtained. The reason is as follows. The discoloration is occurred such that the metallic ink is swollen or soaked into a recording medium, or dissolves a recording medium to be penetrated into the medium and the penetrated ink is oozed out on the surface of a printed matter without being cured after having been printed. However, according to the present invention, temporary curing is performed in addition to leveling and thus a penetrated amount of the metallic ink into a recording medium can be reduced. Therefore, discoloration can be suppressed.

Metallic Ink

A metallic ink used in the printing method in accordance with the present invention is an ultraviolet curing type ink which includes metal particles.

An ultraviolet curing type ink is ink which is cured by irradiation of ultraviolet rays and includes resin such as a monomer or an oligomer polymerized by irradiation of ultraviolet rays as a binder. Such resin may be illustrated as epoxy acrylate, urethane acrylate, polyester acrylate and the like.

A metal particle is a coloring agent which is added for providing a printed matter with metallic texture. A kind of metal may be appropriately selected depending on application of a printed matter and, for example, the metal may be illustrated as silver, aluminum and the like.

A shape of the metal particle is not limited specifically, but scale shape or flat shape may be preferable. Metal particles in scale shape or flat shape are orientated so that their plane directions are parallel to a plane direction of a recording medium and thereby the brightness is further improved.

Further, a leafing type metal particle is further preferable. Since metal particles in scale shape are orientated on the surface of an ink layer so that their plane directions are further parallel to a plane direction of a recording medium, the brightness is further improved.

Recording Medium

A recording medium used in the printing method in accordance with the present invention may be a medium which is swelled by the metallic ink, soaked with the metallic ink, or dissolved by the metallic ink, and may be appropriately selected depending on application of a printed matter. For example, paper, a fabric, vinyl chloride and the like are illustrated. Taking into consideration of operation of the present invention, a recording medium may be a medium which is provided with a receiving layer of resin on a surface where a metallic ink is landed, or may be a medium like paper or vinyl chloride in which a metallic ink is easily oozed. A metallic ink is easily penetrated into a recording medium which is swelled by the metallic ink, soaked with the metallic ink, or dissolved by the metallic ink. However, when the metallic ink is penetrated into a recording medium to some extent, a thickness of the ink layer is set to be thin and orientation of the metal particles is aligned and thereby, the brightness is improved and oozing and discoloration can be prevented after having been printed due to excessive soaking.

In a case that the amount of a metallic ink to be ejected is large, an ink layer becomes thick and thus its surface side is cured and shrunk due to a difference of curability between a surface side of an ink droplet and its bottom side. When shrinkage on curing is occurred, orientation of the metal particles aligned so as to be parallel to a surface direction of a medium is disturbed and the brightness is lowered.

In a case that a recording medium having a receiving layer is used or, in a case that paper, a fabric and the like are used as a recording medium, thickness of the ink layer can be made thinner by penetrating a metallic ink into the recording medium in such a degree that the metallic ink is not oozed and discolored. As a result, a difference of curability between a surface side of an ink droplet and its bottom side can be made smaller and thus shrinkage on curing of the surface side can be suppressed. Therefore, disturbance of the orientation of the metal particles can be suppressed and a high brightness can be secured.

When a receiving layer is provided on a recording medium, a recording medium to which a metallic ink is hard to adhere is capable of being used. A person skilled in the art can easily understand what resin is used for forming the receiving layer. The receiving layer is also referred to as an ink receiving layer, which is a layer formed on a recording medium for absorbing ink to fix color material such as dye and pigment. For example, the receiving layer is formed of water soluble resin or the like. Further, the receiving layer may be, for example, an aqueous receiving layer such as starch. Further, for example, it is further preferable that the receiving layer is formed of kaolin or titanium oxide and SBR rubber.

Further, it is further preferable that a printing face of a recording medium having a receiving layer is subjected to smoothing processing.

When an ink layer is thinly formed, movement of metal particles is restricted to improve brightness but, on the other hand, when the ink layer is set to be thin, the ink layer is easily affected by a shape of the surface of a recording medium. For example, in a case that the surface smoothness is low, since metal particles are aligned along the surface, the metal particles cannot be sufficiently oriented in a direction parallel to the surface and thus the light may be diffusely reflected to lower the brightness. However, according to the above-mentioned structure, smoothness of a recording medium is improved in comparison with a case that smoothing processing is not performed and thus metal particles are further aligned in order and the brightness is improved.

Ink Ejection Process

An ink ejection process is process in which a metallic ink is ejected on a recording medium.

An ejection method for a metallic ink is not limited specifically but, for example, an inkjet printer may be preferably utilized for printing.

In the ink ejection process, conditions such as amount and pitch of a metallic ink which is ejected by an inkjet printer may be appropriately set depending on application and the like of a printed matter.

An example of a further preferable condition regarding an ejecting condition of a metallic ink by an inkjet printer is a condition that a landed ink droplet is unified with an adjacent ink droplet by being leveled before a main curing process. In other words, in the present invention, it is preferable that ejected ink droplets are set in a unified state at a start point of a main curing process. When adjacent ink droplets are unified with each other, orientation parallel to a plane direction of a recording medium is further promoted. In this case, it is further preferable that a recording medium is provided with a resin layer on a face where a metallic ink is landed, or a recording medium is paper or vinyl chloride. In order to eject a metallic ink so that adjacent ink droplets are unified with each other by leveling, it is required to increase an amount of a metallic ink to be ejected. However, even if a large amount of ink is ejected, the ink layer can be thinly formed when such a recording medium is used and thus a direction in which metal particles are oriented can be restricted to improve the brightness.

A person skilled in the art can easily control an inkjet printer so that a metallic ink is ejected under a condition that adjacent ink droplets are unified with each other before a main curing process is performed on the landed ink droplets. For example, first, a metallic ink is ejected to a test recording medium to perform temporary curing. After the temporarily curing has been performed, a degree of flatness of the ejected ink droplets is observed. If adjacent ink droplets are not unified with each other after leveling is performed, the inkjet printer is adjusted such that an ejection amount is increased or a pitch to be landed is narrowed. By performing such an adjustment, a metallic ink can be ejected by using an inkjet printer so that a landed ink droplet is unified with an adjacent ink droplet before a main curing process is performed.

Thickness of an ink layer which is formed by a metallic ink may be appropriately set depending on a target brightness, a purpose of using a printed matter and the like. Adjustment of thickness of an ink layer may be performed as follows. For example, a metallic ink is ejected to a test recording medium, and temporary curing and main curing are performed under desired conditions and then the thickness of the ink layer is measured. When the ink layer is too thick, an amount of a metallic ink to be ejected is reduced and, when the ink layer is too thin, an amount of the metallic ink to be ejected is increased.

Leveling Process

In a leveling process, a metallic ink on a recording medium is leveled. As a result, metal particles in a metallic ink are oriented to improve the brightness. For example, when the metal particles are oriented so that plane directions of the metal particles in a scale shape are set to be parallel to a plane direction of a recording medium, the brightness is further improved.

It is further preferable that the leveling process is performed by heating a recording medium. When the metallic ink which is landed on a recording medium is heated, wettability of the metallic ink is improved and thereby the metallic ink is extended in a plane direction of the recording medium to perform leveling. As a result, the metal particles in the metallic ink are oriented to improve the brightness. For example, when the metal particles are oriented so that the plane directions of the metal particles in a scale shape are set to be parallel to a plane direction of a recording medium, the brightness is further improved.

As a structure for heating, for example, a heater may be provided in a platen for placing a recording medium.

A heating temperature may be appropriately set depending on a type of a metallic ink or the like and, for example, it is preferable that a surface of a recording medium is heated in a range of 40° C. or more and 70° C. or less, further preferably at 50° C. and thereby the metallic ink is heated. According to this range, the metallic ink is appropriately leveled.

The leveling process is continuously performed also during a temporary curing process. Further, for example, in a case that the leveling process is performed by heating, it is further preferable that heating is started before the ink ejection process is performed so that a recording medium is previously heated and the leveling process is performed until the metallic ink is completely cured. The brightness can be further improved by leveling the metallic ink for a sufficient time.

Temporary Curing Process

In a temporary curing process, ultraviolet rays are irradiated to a metallic ink on a recording medium to cure (temporarily cure) the ink in a degree that the ink is not completely cured.

"A degree that the ink is not completely cured" means that the ink is provided with viscosity where landed ink droplets are extended to some extent in a plane direction of a recording medium when time has passed and leveling is performed.

It is further preferable that a time is secured for sufficiently leveling the metallic ink on a recording medium before a main curing process is performed after the temporary curing process has been performed.

Whether or not metal particles in a metallic ink are oriented or a degree of the orientation may be evaluated in a pseudo manner from a degree of leveling in the surface of the ink layer. A timing when the main curing process is to be performed after the temporary curing process has been performed may be judged based on an evaluation result which is obtained by evaluating a degree of orientation of the metal particles.

Main Curing Process

In the main curing process, ultraviolet rays are irradiated to the metallic ink on the recording medium to cure the metallic ink after the temporary curing process. A printed matter is completed by curing to a target hardness. In other words, in the main curing process, the metallic ink may be cured to such a degree as to be usable as a printed matter depending on a purpose of its use.

Time until the main curing process is performed after the temporary curing process may be appropriately set depending on a target degree of leveling. In other words, it is preferable that the main curing process is performed after a predetermined time set depending on a target brightness has passed after the temporary curing process is performed.

Intensity of the ultraviolet rays to be irradiated may be appropriately set depending on a type of a metallic ink. Intensity of illumination required for curing is determined depending on resin such as a monomer or an oligomer contained as a binder. When a commercially available ink is used, it may be dependent on description of its manual or the like.

EXAMPLE OF PRINTING METHOD IN ACCORDANCE WITH PRESENT INVENTION

Example 1

Figure 2:
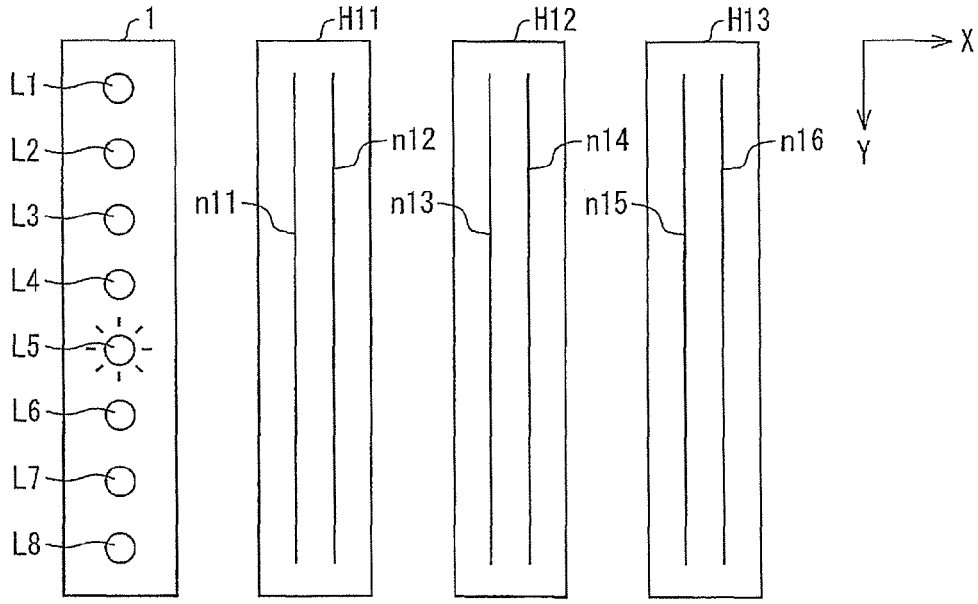
FIG. 2 is a view showing another structure of a head and an ultraviolet irradiation part of an inkjet printer for performing a printing method in accordance with the present invention.

Next, an embodiment of a printing method in accordance with the present invention will be described below with reference to FIGS. 1 and 2. FIG. 1 is a view showing a structure of a head and an ultraviolet irradiation part of an inkjet printer for performing a printing method in accordance with the present invention. FIG. 2 is a view showing another structure of a head and an ultraviolet irradiation part of an inkjet printer for performing a printing method in accordance with the present invention.

First, a case in which an inkjet machine shown in FIG. 1 is used will be described below. A head H1, a head H2, a head H3, an ultraviolet irradiation part 1 are disposed over a medium (recording medium) as shown in FIG. 1. The heads H1 through H3 are arranged in a staggered manner.

The head H1 is provided with nozzle arrays n1 and n2, the head H2 is provided with nozzle arrays n3 and n4, and the head H3 is provided with nozzle arrays n5 and n6.

The nozzle array n1 is a row of nozzles for ejecting a yellow ink (Y), the nozzle array n2 is a row of nozzles for ejecting a magenta ink (M), the nozzle array n3 is a row of nozzles for ejecting a cyan ink (C), the nozzle array n4 is a row of nozzles for ejecting a black ink (K), the nozzle array n5 is a row of nozzles for ejecting a metallic ink, and the nozzle array n6 is a row of nozzles for ejecting a clear ink. The clear ink is ink for forming a protective layer on an image formed by using other colors.

Ultraviolet lamps L1 through L8 are provided at an equal interval in the ultraviolet irradiation part 1.

Further, a heater (not shown) for heating a medium is provided in a platen on which the medium is placed.

First, all of the heads H1 through H3 and the ultraviolet irradiation part 1 are moved in the arrow "X" direction and, while scanning on the medium, a metallic ink is ejected from the nozzle array n5 and landed on the medium based on image information to be printed (ink ejection process).

Since the medium is heated by the heater, the metallic ink which has been landed on the medium is also heated (leveling process). As a result, leveling of the metallic ink on the medium is progressed. When this scanning is being performed, only the ultraviolet lamp L1 of the ultraviolet irradiation part 1 irradiates ultraviolet rays. The intensity of illumination in this case is adjusted to 20% of the intensity of illumination when the metallic ink is cured in the main curing. The positions in the arrow "Y" direction between the nozzle n5 and the ultraviolet lamp L1 are displaced from each other. In other words, the ultraviolet lamp L1 and the nozzle n5 are separated from each other with a certain distance. Therefore, the metallic ink ejected from the nozzle n5 is irradiated with ultraviolet rays from the ultraviolet lamp L1 to such a degree that leveling is not obstructed. As a result, the temporary curing is performed (temporary curing process).

When the above-mentioned scanning is finished, the entire heads H1 through H3 and the ultraviolet irradiation part 1 are moved by a distance of one head in the arrow "Y" direction. In this example, the medium is fixed. While scanning in the arrow "X" direction again, a metallic ink is ejected from the nozzle array n5. In this case, ultraviolet rays of the ultraviolet lamp L1 are irradiated on the metallic ink having been ejected from the nozzle array n5 in the previous scanning and the temporary curing is further performed (temporary curing process).

An image is formed by repeating the above-mentioned processes. In this case, the metallic ink on the medium is leveled from one scanning to the next scanning and, after having been temporarily cured by the succeeding scanning, the metallic ink is further gradually leveled.

When forming of an image is finished, the entire heads H1 through H3 and the ultraviolet irradiation part 1 are returned to the original position and then outputs of irradiation of all of the ultraviolet lamps L1 through L8 are increased to 100%, which is the intensity of illumination when the main curing is performed and the medium is scanned again. As a result, the main curing is performed (main curing process).

Example 2

Next, another example will be described below with reference to FIG. 2. In FIG. 2, an ultraviolet irradiation part 1 has the same structure as the example 1 but heads H11 through H13 are arranged in parallel different from a staggered arrangement in the example 1. A nozzle array n11 is a row of nozzles for ejecting a yellow ink (Y), a nozzle array n12 is a row of nozzles for ejecting a magenta ink (M), a nozzle array n13 is a row of nozzles for ejecting a cyan ink (C), a nozzle array n14 is a row of nozzles for ejecting a black ink (K), a nozzle array n15 is a row of nozzles for ejecting a metallic ink, and a nozzle array n16 is a row of nozzles for ejecting a clear ink.

First, all of the heads H11 through H13 and the ultraviolet irradiation part 1 are moved in the arrow "X" direction and, while scanning on a medium, a metallic ink is ejected from the nozzle array n15 and landed on the medium based on image information to be printed (ink ejection process).

In this case, only the ultraviolet lamp L5 irradiates ultraviolet rays. The intensity of illumination in this case is adjusted to 20% of the intensity of illumination when the metallic ink is cured in the main curing. As a result, ultraviolet rays are irradiated to the metallic ink which is ejected from the nozzle array n15 and landed on the medium and the metallic ink is temporarily cured (temporary curing process). The ultraviolet lamp used when the temporary curing is performed is not limited to the ultraviolet lamp L5 and another ultraviolet lamp may be used depending on a target degree of the temporary curing.

Further, since the medium is heated by a heater before the temporary curing is performed, the metallic ink on the medium is heated immediately after having been landed (leveling process).

When one scanning is finished, the entire heads H11 through H13 and the ultraviolet irradiation part 1 are moved by a distance of one head in the arrow "Y" direction. Also in this example, the medium is fixed.

When forming of an image is finished, the entire heads H11 through H13 and the ultraviolet irradiation part 1 are returned to the original position and then the irradiating outputs of all of the ultraviolet lamps L11 through L18 are increased to 100%, which is the intensity of illumination when the main curing is performed and the medium is scanned again. As a result, the main curing is performed (main curing process).

In the example 2, a time period from landing of a metallic ink until a temporary curing is performed is shorter in comparison with that in the example 1, it is preferable that a further long time period is secured after the temporary curing process is performed until the start of the main curing process.

The present invention is not limited to the above-mentioned embodiments and various changes and modifications will be included in a scope described in claims and embodiments obtained by appropriately combining technical means respectively disclosed in different embodiments are also included in a technical scope of the present invention.

INDUSTRIAL APPLICABILITY

The present invention may be utilized in printing with the use of a metallic ink.

The invention claimed is:

1. A printing method, comprising:

an ink ejection process, in which an ultraviolet curing type metallic ink including a monomer or an oligomer polymerized by irradiation of ultraviolet rays as a binder and scale shape or flat shape metal particles is ejected on a recording medium, and the recording medium is swelled by the metallic ink, soaked with the metallic ink, or dissolved by the metallic ink;

a leveling process, in which the metallic ink on the recording medium is leveled, and the metal particles are aligned in a plane direction parallel to a surface of the recording medium in a state that the metal particles are interposed between the recording medium and a surface of an ink layer;

a temporary curing process, in which ultraviolet rays are irradiated to the metallic ink on the recording medium and the leveling process is continuously performed, and a penetrated amount of the metallic ink into the recording medium is reduced; and a main curing process, in which ultraviolet rays are irradiated to the metallic ink on the recording medium for curing after the temporary curing process, wherein the metallic ink is ejected by an inkjet printer so that landed ink droplets are flattened and unified with adjacent ink droplets before the main curing process is performed.

2. The printing method according to claim 1, wherein the recording medium is provided with a receiving layer on a face where the metallic ink is landed, or the recording medium is paper or vinyl chloride.

3. The printing method according to claim 2, wherein a printing face of the recording medium which is provided with the receiving layer is performed with smoothing processing.

4. The printing method according to claim 2, wherein the leveling process is performed by heating the recording medium.

5. The printing method according to claim 3, wherein the leveling process is performed by heating the recording medium.

6. The printing method according to claim 1, wherein the leveling process is performed by heating the recording medium.

7. The printing method according to claim 6, wherein in the leveling process, a surface of the recording medium is heated in a range of 40° C. or more and 70° C. or less and thereby the metallic ink is heated.

8. The printing method according to claim 1, wherein the metal particle is a leafing type particle, and the metal particles are orientated on a surface of an ink layer so that plane directions of the metal particles are further parallel to a plane direction of the recording medium.

9. The printing method according to claim 1, wherein the leveling process is performed by heating the recording medium.

10. The printing method according to claim 1, wherein a printing face of the recording medium which is provided with a receiving layer is performed with smoothing processing.

* * * * *